US007367869B2

(12) United States Patent
Williams et al.

(10) Patent No.: US 7,367,869 B2
(45) Date of Patent: May 6, 2008

(54) METHOD OF MASKING AND A HOT MELT ADHESIVE FOR USE THEREWITH

(75) Inventors: Raymond F. Williams, Massillon, OH (US); Casey Williams, Massillon, OH (US)

(73) Assignee: U.S. Technology Corporation, Canton, OH (US)

( * ) Notice: Subject to any disclaimer, the term of this patent is extended or adjusted under 35 U.S.C. 154(b) by 82 days.

(21) Appl. No.: 11/415,742

(22) Filed: May 2, 2006

(65) Prior Publication Data

US 2007/0259606 A1 Nov. 8, 2007

(51) Int. Cl.
*B24B 1/00* (2006.01)

(52) U.S. Cl. ..... 451/31; 451/29

(58) Field of Classification Search ..... 451/29, 451/30, 31, 445

See application file for complete search history.

(56) References Cited

U.S. PATENT DOCUMENTS 4,093,754 A * 6/1978 Parsons ..... 427/259
5,912,295 A 6/1999 Oeltjen et al.
5,958,170 A * 9/1999 Cetrangolo ..... 156/247
5,989,689 A * 11/1999 Komatsu ..... 428/201
6,037,106 A * 3/2000 Komatsu ..... 430/323

* cited by examiner

*Primary Examiner*—Dung Van Nguyen
(74) *Attorney, Agent, or Firm*—Sand & Sebolt

(57) ABSTRACT

A method of masking includes adhering a removable pressure sensitive adhesive to a masking surface to cover the masking surface and blasting the adhesive and an adjacent target surface with abrasive blast media to remove material forming the target surface wherein the adhesive protects against removal of material forming the masking surface. The blasting media does not abrade the adhesive. The adhesive may be applied in molten form or at room temperature by separating the adhesive from a flexible release liner. The adhesive may be removed by simply peeling the adhesive from the masking surface, leaving the masking surface essentially free of residue. Due to the adhesive characteristics throughout the adhesive, some blast media adheres to the adhesive and forms a barrier layer which repels additional blast media. The adhesive may also be used to adhere a masking device over the masking surface to cover large areas easily.

36 Claims, 7 Drawing Sheets

METHOD OF MASKING AND A HOT MELT ADHESIVE FOR USE THEREWITH

BACKGROUND OF THE INVENTION

1. Technical Field

The invention relates generally to masking to protect sensitive areas or areas which do not require application of or removal of coatings adjacent other areas where it is desired to apply or remove such coatings. More particularly, the invention relates to a masking material formed of a removable pressure sensitive adhesive. Specifically, the invention relates to a hot melt pressure sensitive adhesive which is easily removed by hand.

2. Background Information

Historically, masking has been utilized on aircraft, automobiles, equipment, rigs, ships and other structures to protect sensitive areas or areas not requiring cleaning, removal of a coating, or application of a coating from abrasive blasting, chemical stripper, new coatings, solvents or other exposure. This masking has been achieved by using a combination of tapes, hot glue, masking devices or sheet material. These traditional masking devices are time consuming in their application and removal and may or may not be adequate in their protection capabilities. In addition, they are typically rather expensive.

For example, it is generally difficult to remove hot glue, which must normally be chipped in multiple pieces from the surface that it was masking. In addition, hot glue embeds itself in tight places such as hinges, again compounding the difficulty of removal. Furthermore, adhesive tapes used in abrasive blasting generally do not have sufficient adhesion to withstand the blasting process to its edges even at low pressures such as 25 psi. Because of this drawback of such adhesive tapes, it has been required that hot glue be used to hold the edges of the adhesive tape down. Thus, abrasive blasting such as that used to depaint aircraft and the like requires the application of such adhesive tapes, which are typically rubberized, as well as the hot glue, thus making a costly and labor intensive masking device.

Thus, there is a need in the art for a masking material and process which reduces the labor hours required to mask and unmask an aircraft or the like while providing high quality masking. The present invention addresses this and other problems.

BRIEF SUMMARY OF THE INVENTION

The present invention provides a method comprising the steps of adhering a removable pressure sensitive adhesive to a masking surface; and blasting the adhesive and a target surface adjacent the masking surface with abrasive blast media to remove material forming the target surface wherein the adhesive protects against removal of material forming the masking surface.

BRIEF DESCRIPTION OF THE SEVERAL VIEWS OF THE DRAWINGS

Similar numbers refer to similar parts throughout the specification.

DETAILED DESCRIPTION OF THE INVENTION

Figure 1:
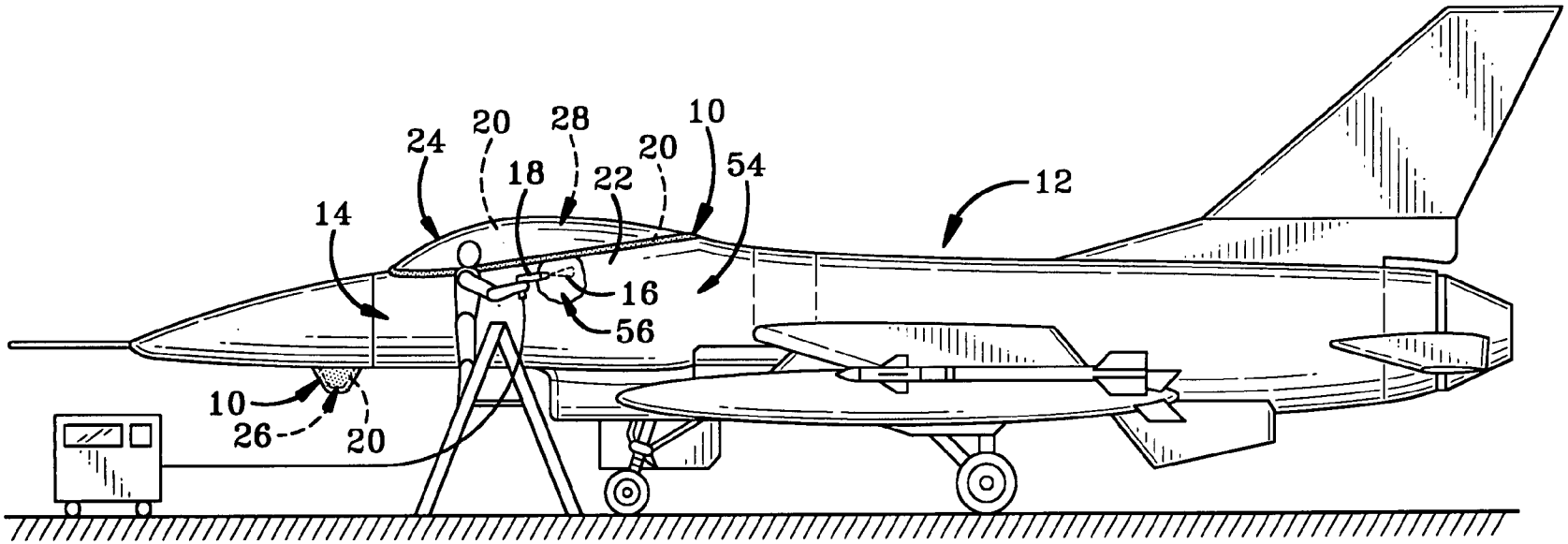
FIG. 1 is a side elevational view of an aircraft utilizing a masking material in the form of the pressure sensitive adhesive of the present invention and showing the aircraft being blasted by abrasive blast media to remove paint therefrom.
Figure 2:
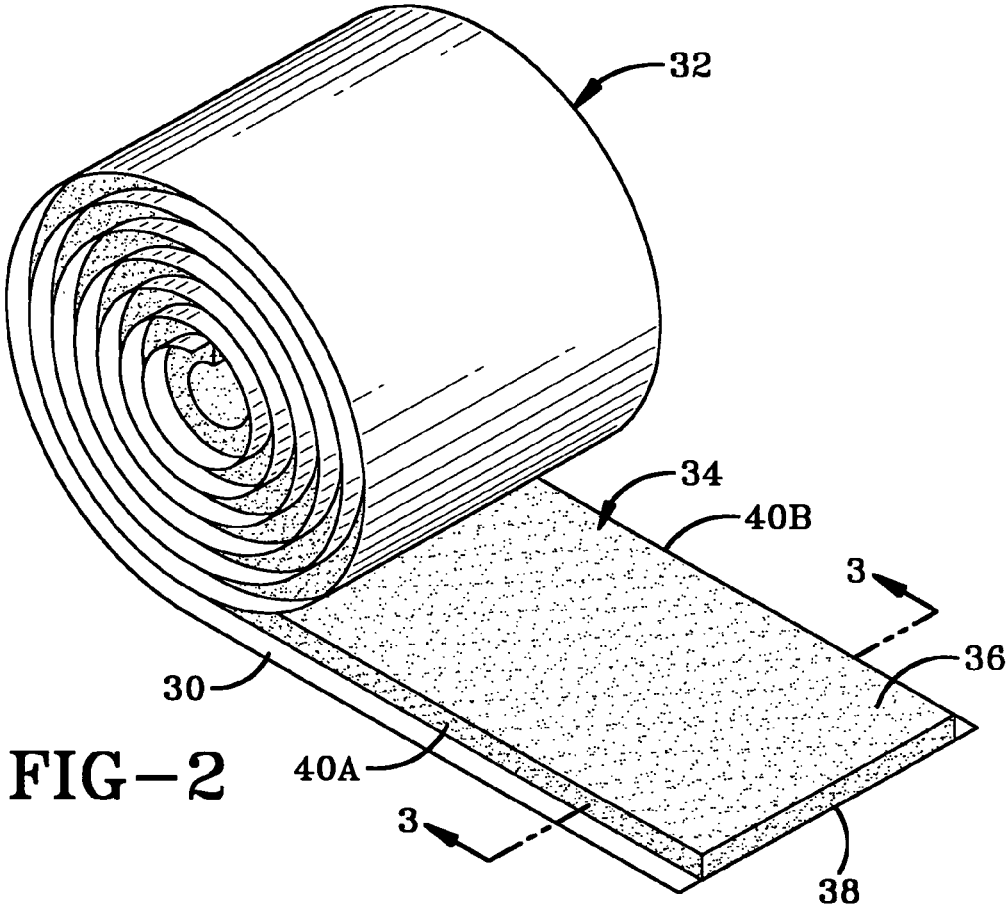
FIG. 2 is a perspective view of a roll of the adhesive of the present invention stored on a release liner.
Figure 3:
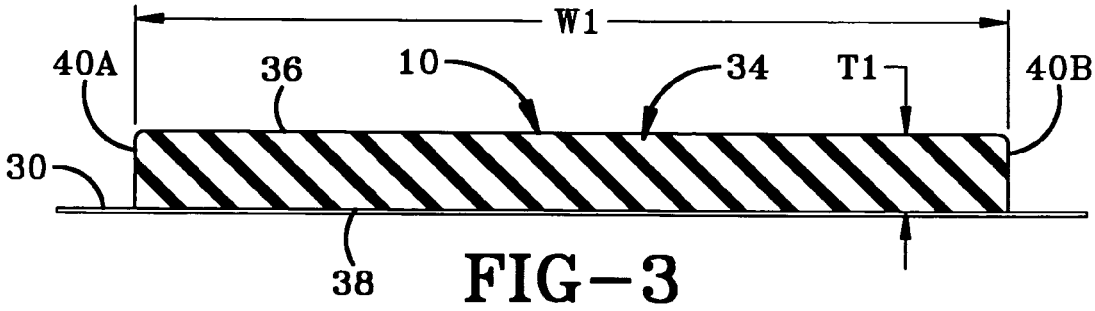
FIG. 3 is a sectional view of the adhesive taken on line 3-3 of FIG. 2.

The adhesive of the present invention is indicated generally at 10 in FIGS. 1-3 and the method of using the adhesive is shown generally in FIGS. 4-13. With reference to FIG. 1, adhesive 10 is shown adhered as a masking material on a target structure in the form of an aircraft 12 having an outer surface a portion of which is to be affected by an interactive material and a portion of which is to be protected by adhesive 10 from the interactive material, which is in the form of abrasive blast media 16 and which is propelled or blasted from a blasting device 18. The portion of outer surface 14 that is covered by and is to be protected by adhesive 10 is referred to herein as a masking surface 20 and the portion of outer surface 14 which is to be affected by blast media 16 is referred to herein as a target surface 22. Masking surface 20 may be covered entirely by adhesive 10 or partially covered thereby along with a masking device 24 typically in the form of a flexible sheet of material such as Mylar®, rubber, an elastomer or other suitable material. More particularly and by way of example, aircraft 12 includes an antenna 26 which is completely covered by adhesive 10 and a cockpit canopy/windshield combination 28 which is covered by masking device 24 and adhesive 10, which adheres masking device 24 to aircraft 12.

Adhesive 10 has been used in a variety of applications as an adhesive, but to Applicant's knowledge has not been previously used as a masking material. Adhesive 10 is a removable pressure sensitive adhesive which is most typically a hot melt pressure sensitive adhesive. Such adhesives may be divided into four general categories including permanent, semi-permanent, removable and freezer categories. Permanent adhesives permanently adhere one substrate to another and either have substrate failing or substrate distorting bonds. Semi-permanent adhesives are repositionable for a short period of time after application of one substrate to another. Freezer grade adhesives have good adhesion to substrates at temperatures of about −30° C.

Removable hot melt pressure sensitive adhesives allow separation of substrates any time after application of one substrate to another without substrate failure or adhesive transfer. These adhesives typically have low 180° peel values and high initial tack, which is typically achieved with high levels of block copolymers, low levels of tackifying resin and high levels of a plasticizing oil.

While the present invention contemplates that adhesive 10 may be formed of any removable pressure sensitive adhesive suitable to the purposes of masking as further detailed below, one preferred embodiment of adhesive 10 is available through HAR Adhesive Technologies of Bedford, Ohio and is known as hotmelt 1276. Hotmelt 1276 is a removable grade hotmelt pressure sensitive adhesive which provides excellent wetout, good stain resistance and a soft removable tack. Hotmelt 1276 is composed of 20-30% by weight plasticizing oil, 40-50% by weight block copolymers and 24-34% by weight tackifying resins with less than 1% antioxidants. A more preferred range for the plasticizing oil is 22-28% by weight and a preferred embodiment contains about 25% plasticizing oil. A more preferred range of block copolymers is 42-48% by weight with the preferred embodiment containing about 45% by weight block copolymers. A preferred range of the tackifying resins is 26-32% with the preferred embodiment containing about 29% tackifying resins.

For use in the abrasive blasting process, adhesive 10 must have enough tack to withstand the blasting and also be easily removed after blasting while leaving no surface residue. Adhesive 10 preferably has a loop tack value to stainless steel of 37-43 ounces per square inch with the preferred embodiment having a loop tack value of about 40 ounces per square inch. Adhesive 10 has a 90° peel value to stainless steel of 0.8 to 1.0 pounds per linear inch with a preferred embodiment having a 90° peel value of 0.9 pounds per linear inch. Adhesive 10 has a 180° peel value to stainless steel of 1.1 to 1.3 pounds per linear inch with a preferred embodiment having a 180° peel value of 1.2 pounds per linear inch.

Hotmelt 1276 may be applied by a cold (room temperature) application method or a hot application method. In the cold application method, hotmelt 1276 is formed in a strip or tape which may have various widths typically up to about four inches although this may vary. In the hot application method, hotmelt 1276 is applied in molten form with an automated or handheld applicator which applies a ribbon of the material typically up to about two inches wide, although this may vary. The hot application temperature range of hotmelt 1276 is about 300-325° F. The viscosity of hotmelt 1276 ranges from about 18,000-24,000 cPs (mPa.s) at 325° F. with the preferred embodiment having a viscosity of about 20,200 cPs at 325° F. The viscosity at 300° F. ranges from about 58,000-62,000 cPs with the preferred embodiment having a viscosity of about 60,500 cPs.

More broadly, adhesive 10 is an elastomeric adhesive which has a substantial ability to elongate or stretch, which facilitates removal of adhesive 10 from tight spaces, as will be detailed further below. For example, adhesive 10 typically is able to elongate to a length which is twice, three times, five times, ten times, or even greater than its original length. In addition, adhesive 10 has adhesive characteristics throughout itself and on all external surfaces thereof.

With reference to FIG. 2, adhesive 10 is shown releasably attached to a release liner 30 which is coiled up with adhesive 10 into a roll 32 for convenient storage, transportation and usage of adhesive 10. Alternately, adhesive 10 may be releasably attached to a release liner in the form of a flat sheet or to a pair of sheets with adhesive 10 disposed therebetween.

Adhesive 10 is typically used in the form of an elongated strip or ribbon 34 as shown in FIG. 2. With reference to FIG. 3, ribbon 34 has a first or inner surface 36 and a second or outer surface 38 opposed thereto wherein surfaces 36 and 38 define therebetween a thickness T1. While thickness T1 may vary, it typically ranges from approximately ⅛ inch to ¼ inch. While thickness T1 may be greater or less than this range, it should be of a sufficient thickness in order to remove ribbon 34 without tearing thereof or with minimal tearing thereof. In addition, it is desirable to maintain thickness T1 at a relatively minimal value in order to minimize the amount of adhesive 10 required for the purpose of masking. Ribbon 34 further includes first and second opposed edges 40A and 40B each of which extends from inner surface 36 to outer surface 38. First and second edges 40A and B define therebetween a width W1 which is typically up to about four inches. Width W1 may be quite small depending on the width of a masking surface to be covered. In addition, width W1 may be greater than four inches, however, it is noted that the handling of ribbon 34 becomes more difficult as width W1 increases.

Figure 5:
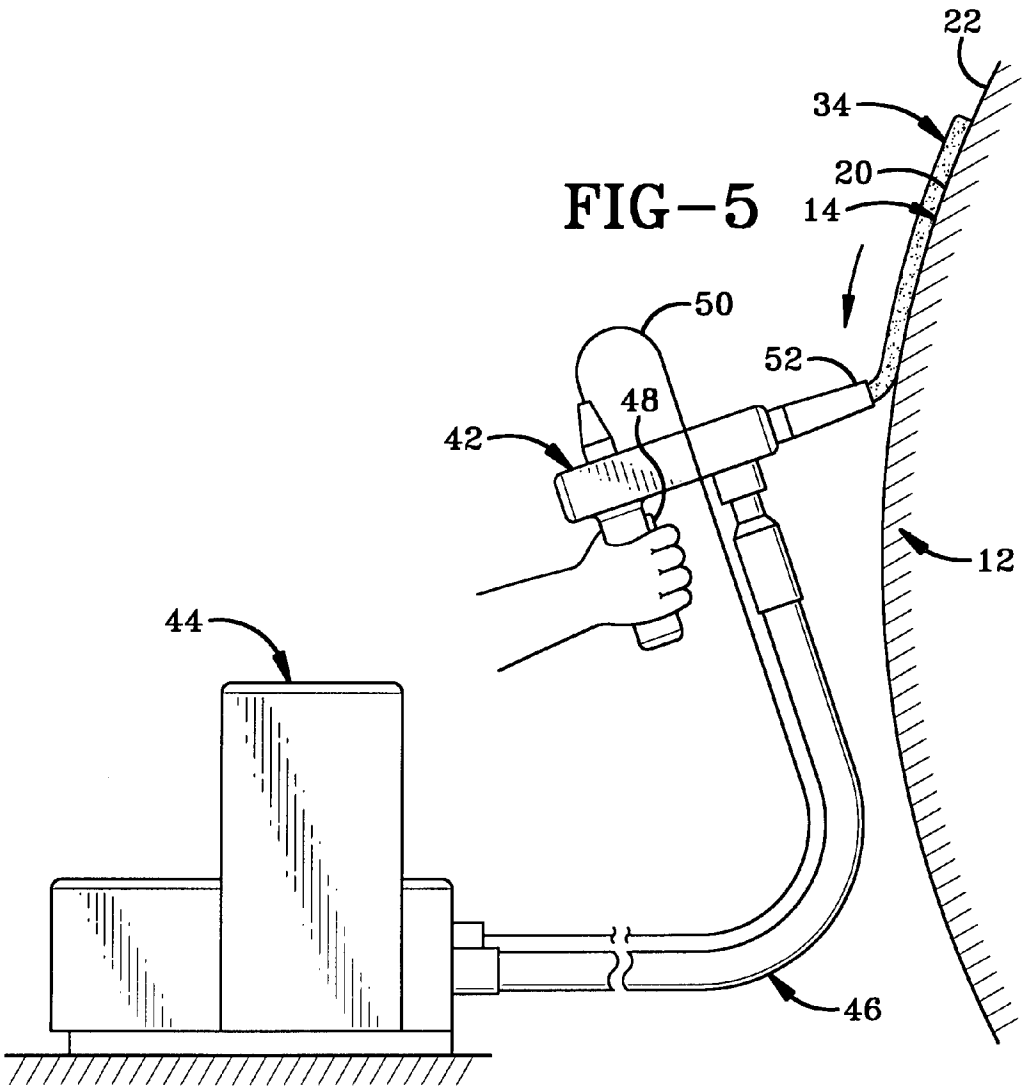
FIG. 5 is a fragmentary end view of the aircraft with a hot melt applicator applying the adhesive in molten form to the aircraft.
Figure 4:
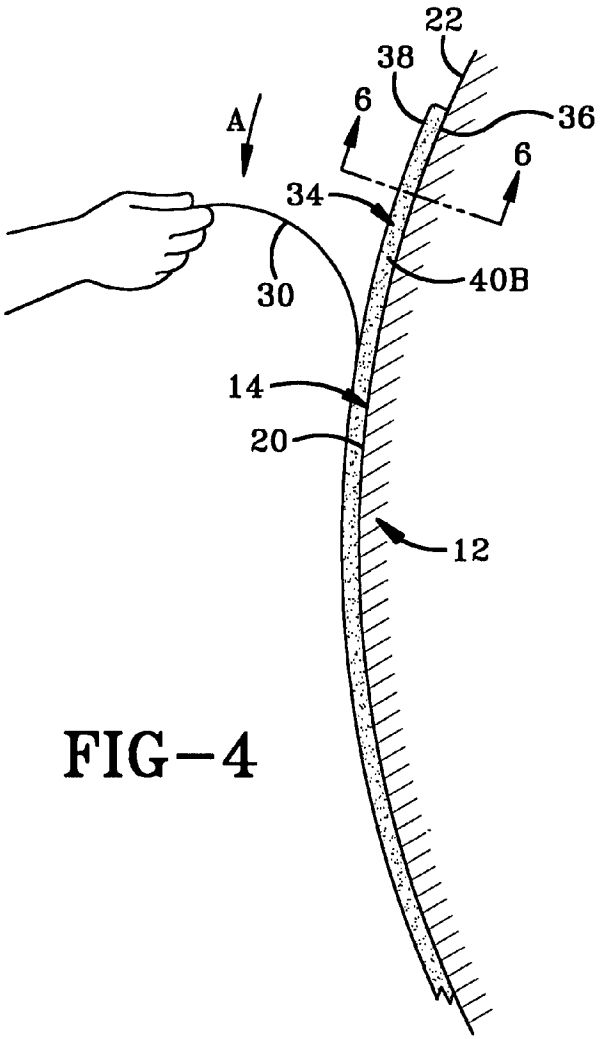
FIG. 4 is a fragmentary end view of the aircraft of FIG. 1 showing the adhesive being applied to the aircraft and the release liner being peeled back.
Figure 6:
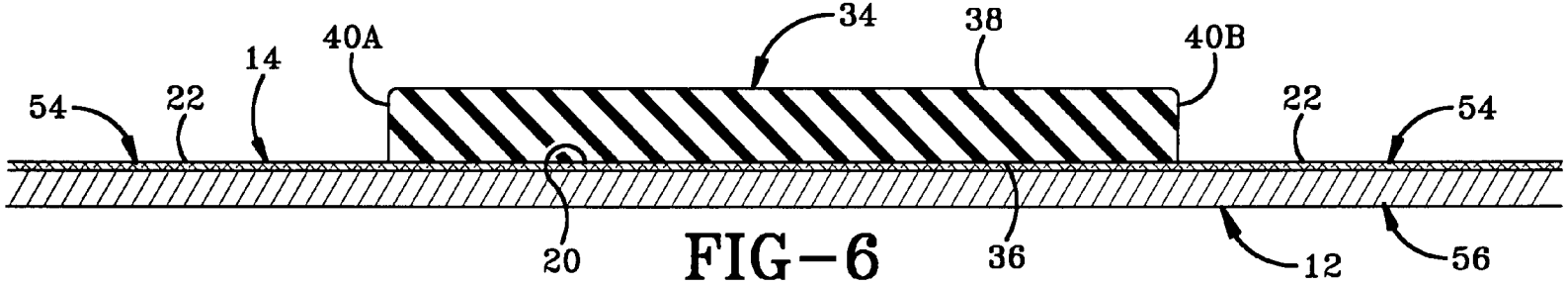
FIG. 6 is a sectional view taken on line 6-6 of FIG. 4.

With reference to FIGS. 4-10, the method of using adhesive 10 is now described. Where adhesive 10 comes in a roll 32 or is similarly mounted on release liner 30, adhesive 10 may be applied to masking surface 20 as indicated in FIG. 4 with inner surface 36 adhered to masking surface 20. Release liner 30 is then pulled away from ribbon 34 as indicated at Arrow A to separate release liner 30 from outer surface 38 of ribbon 34. Alternately, as shown in FIG. 5, ribbon 34 may be applied in molten form with a hotmelt applicator 42 which is in the exemplary embodiment a handheld applicator. A suitable handheld applicator is available through ITW Dynatec of Hendersonville, Tenn. Applicator 42 is typically used with a hotmelt adhesive supply unit 44 (also available through ITW Dynatec) and is connected thereto with a delivery tube 46 which delivers molten adhesive 10. More particularly, supply unit 44 has a heating unit which melts adhesive 10 therein and a pump which is activated in response to pulling a trigger 48 of applicator 42, which communicates an electrical signal to the pump via through electric circuit 50. Supply unit 44 then pumps molten adhesive 10 through tube 46 to tip 52 of applicator 42. Typically, applicator 42 is used in difficult areas and angles where ribbon 34 of adhesive 10 is not feasible. The cold application method avoids safety concerns associated with temperatures involved with the hot melt application.

Once adhesive 10 has been applied to all masking surfaces desired (FIG. 6), blasting device 18 (FIG. 7) is used to blast or propel blast media 16 into contact with target surface 22 and adhesive 10 in order to abrade the material forming target surface 22 while adhesive 10 protects masking surface 20. More particularly, the material forming target surface 22 is a coating or layer 54 which is adhered to a substrate 56 typically in the form of a skin or portion of a frame of aircraft 12. Layer 54 is typically paint with regard to aircraft 12 although it may be desirable to remove any type of surface material other than paint for a given target structure such as aircraft 12. Blasting device 18 propels blast media 16 at a pressure which typically ranges from 25 to 50 psi and most commonly at about 35 psi although the pressure may be as high as 100 psi. With regard to aircraft 12, blasting device 18 is typically not operated above about 45 psi.

Figure 7:
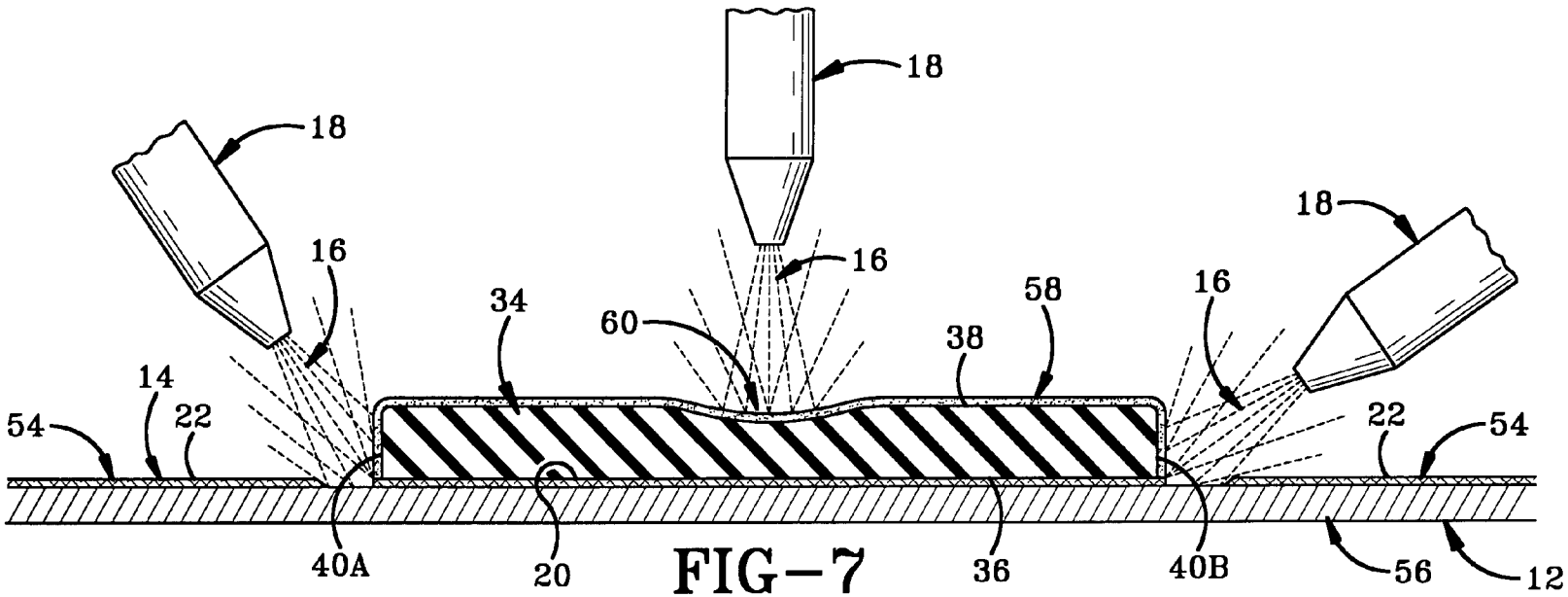
FIG. 7 is a sectional view of the aircraft and adhesive showing abrasive blasting devices propelling blast media toward the aircraft and adhesive with some of the blast media sticking to the adhesive to form a barrier layer which repels additional blast media.
Figure 8:
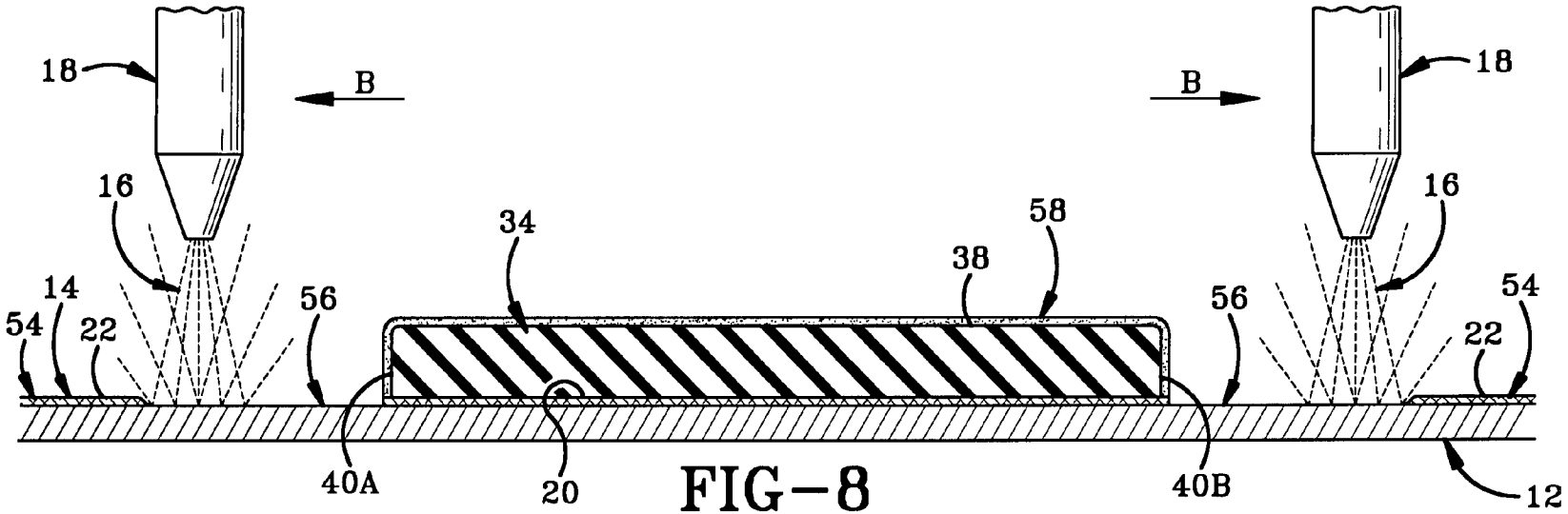
FIG. 8 is similar to FIG. 6 and shows the layer of paint of the target surface being removed.

As blast media 16 is propelled toward aircraft 12 to abrade target surface 22, some of blast media 16 adheres to adhesive 10 on outer surface 38 and edges 40A and 40B thereof to form a barrier layer 58 of media 16 which repels additional blast media 16 that is propelled toward adhesive 10, as shown in FIG. 7. The blast or propulsion of blast media 16 and the compressed air or air/water mixture coming from blasting device 18 stretches a portion of adhesive 10 as indicated at a depression 60 along outer surface 38 of ribbon 34 without ribbon 34 releasing from masking surface 20. FIG. 7 further shows three blasting devices 18 which are aimed toward ribbon 34 of adhesive 10 from different angles to emphasize the fact that the blasting of media 16 from virtually any angle will not cause ribbon 34 to separate from masking surface 20, even when media 16 is directed at edges 40 of ribbon 34 at 50 psi. Thus, ribbon 34 of adhesive 10 has a tack and stretching characteristics suitable to allow ribbon 34 to remain attached to masking surface 20 and also not be abraded by blast media 16. As shown in FIG. 8, layer 54 which forms target surface 22 continues to be removed as blasting devices 18 move as indicated at Arrows B while the material making up masking surface 20 remains intact due to the protection provided by ribbon 34 of adhesive 10.

Figure 9:
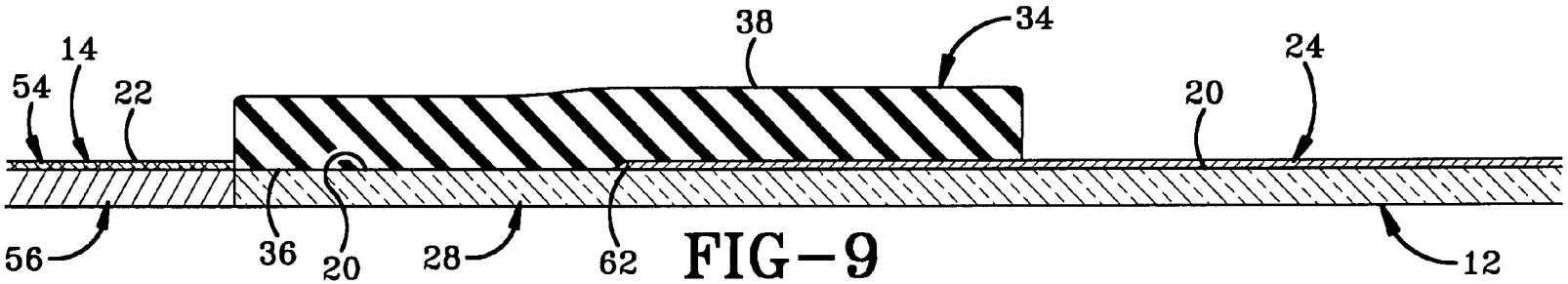
FIG. 9 is similar to FIG. 6 and shows the aircraft with a masking device in sheet form and the adhesive adhering the masking device to the aircraft.

FIG. 9 shows adhesive 10 in use with masking device 24. More particularly, as previously noted, masking device 24 is in the form of a sheet of material having an outer edge 62 along which adhesive 10 is applied in order to adhere masking device 24 to aircraft 12 so that adhesive 10 and masking device 24 together cover a portion of masking surface 20. More particularly, masking device 24 covers canopy/windshield combination 28 of the aircraft cockpit. Adhesive 10 covers edge 62, a portion of masking device 24 adjacent edge 62 to which adhesive 10 is adhered and a portion of masking surface 24 along the canopy of the cockpit. One ribbon 34 and masking device 24 are in place, layer 54 forming target surface 22 is removed as previously described while ribbon 34 and masking device 24 protect combination 28.

Figure 11:
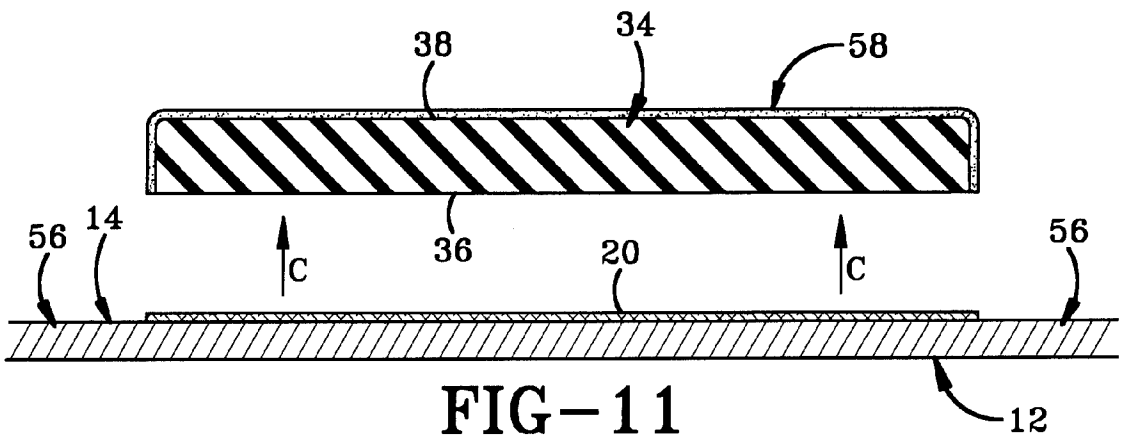
FIG. 11 is a sectional view taken on line 11-11 of FIG. 10.
Figure 10:
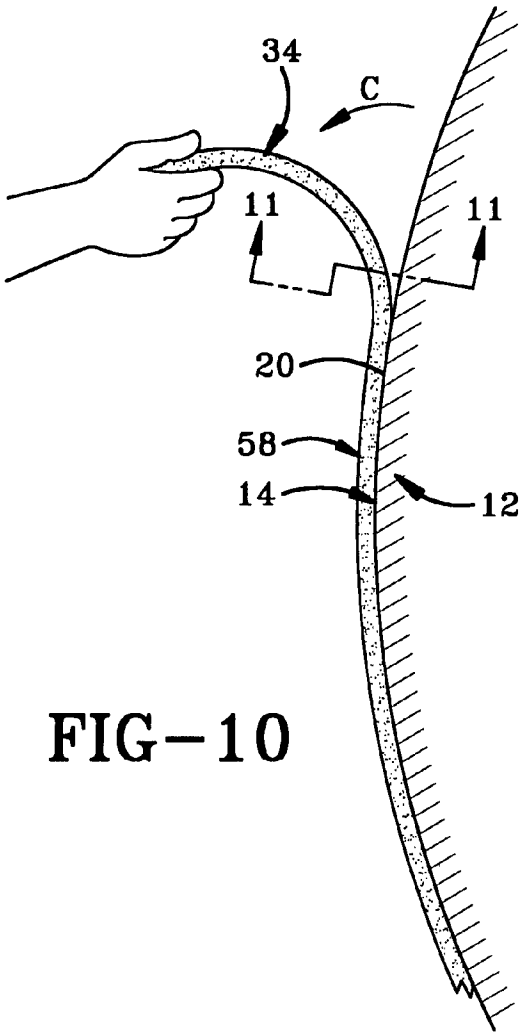
FIG. 10 is a fragmentary end view of the aircraft showing a ribbon of the adhesive being removed by hand.

Once the depainting or the removal of layer 54 has been achieved, ribbons 34 of adhesive 10 are removed by hand, as shown in FIGS. 10 and 11. More particularly, the user simply grasps ribbon 34 and pulls it away from masking surface 20 of aircraft 12 as indicated at Arrows C in order to remove ribbon 34 therefrom. The barrier layer 58 formed on ribbon 34 of course is also removed in this simple process. Conveniently, the removal of ribbon 34 is accomplished without the use of tools. In the preferred embodiment, masking surface 20 is free of or essentially free of any residue caused by adhesive 10.

Figure 12:
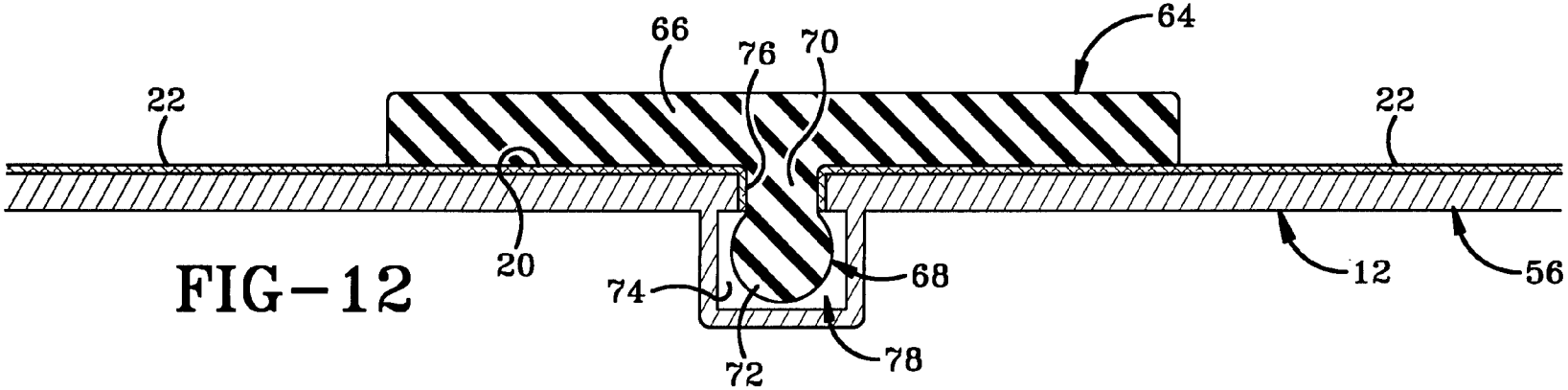
FIG. 12 is a sectional view similar to FIG. 6 showing a ribbon of the adhesive having a projection within a cavity extending inwardly from the masking surface.
Figure 13:
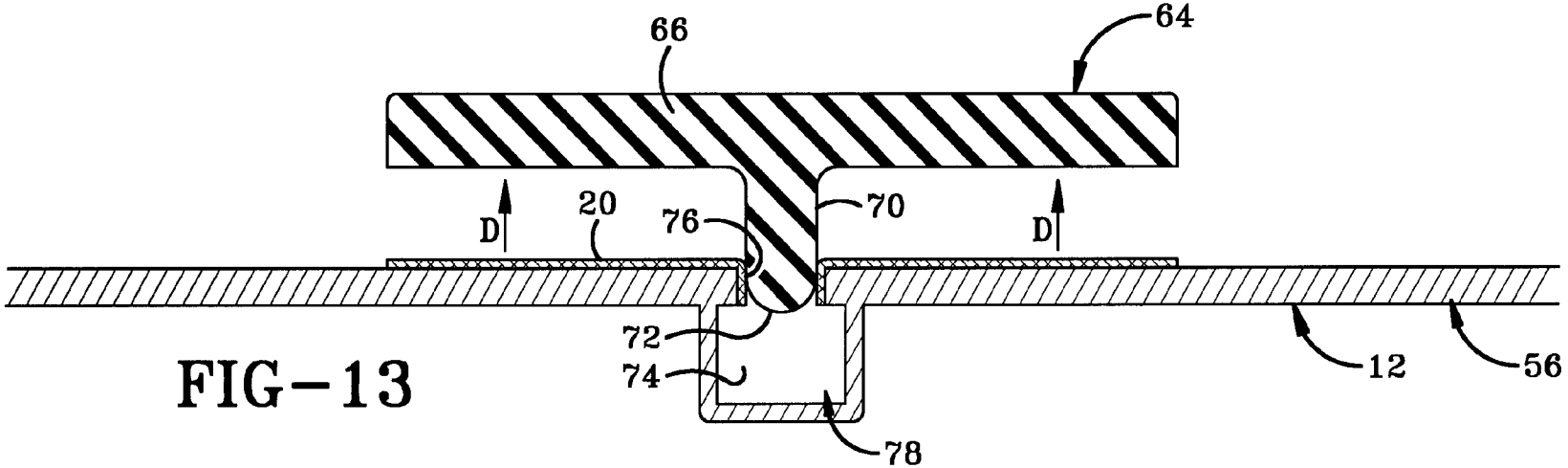
FIG. 13 is similar to FIG. 12 and shows removal of the ribbon from the masking surface and the adhesive stretching to remove the projection from the cavity.

FIGS. 12 and 13 illustrate an additional advantage of the stretching characteristics of adhesive 10. More particularly, FIG. 11 shows a ribbon 64 of adhesive 10 which has been applied in molten form by a hot melt applicator such as applicator 42 so that a portion of ribbon 64 extends into a cavity defined by aircraft 12 adjacent masking surface 20 thereof. More particularly, ribbon 64 includes a body 66 and a projection 68 projecting therefrom. Projection 68 includes a relatively narrow neck 70 extending from body 66 and a head 72 which is connected to neck 70 distal body 66 and which is wider than neck 70. More particularly, projection 68 is disposed in a cavity 74 defined by aircraft 12. Cavity 74 includes a narrower portion 76 extending inwardly from masking surface 20 and a wider portion 78 in communication with neck 76 and disposed distal masking surface 20. Thus, neck 70 is disposed in narrower portion 76 and has a mating configuration therewith and head 72 is disposed in wider portion 78. The formation of projection 68 occurs as the molten adhesive 10 is applied to masking surface 20 so that adhesive 10 is effectively extruded through narrower portion 76 and into wider portion 70 of cavity 74 to form projection 68. Head 72 of projection 68 is wider than narrower portion 76 of cavity 74 and thus if projection 68 were formed of a rigid material, the removal of head 72 would be precluded by interference of the portion of aircraft forming narrower portion 76. However, as shown in FIG. 12, adhesive 10 has stretching characteristics which allow neck 70 and head 72 of projection 68 to narrow as body 66 is pulled away from masking surface 20 as indicated at Arrows D, thus allowing head 72 to pass through narrower portion 76 while ribbon 64 remains as an integral continuous piece. Thus, neck 70 and head 72 are removed simply by pulling ribbon 34 away from aircraft 12 without leaving any portion of adhesive 10 within cavity 74.

While FIGS. 11 and 12 illustrate that the stretching characteristics of adhesive 10 allow removal of a relatively larger portion such as head 72 through a relatively narrow gap such as narrower portion 76 of cavity 74, these stretching characteristics are also beneficial in removing adhesive 10 from cavities and crevices in which no portion of a projection within the cavity is wider than a narrower section of the cavity. For example, the stretching characteristics of adhesive 10 are still useful for removal of adhesive 10 from within a cavity defined by parallel walls. In such a case, a rigid adhesive material such as hot glue would still be difficult to remove from such a cavity because it is unable to stretch like adhesive 10.

Thus, the method of using adhesive 10 as a masking material provides a greatly expedited masking and unmasking procedure. As previously discussed, adhesive 10 can be applied by either a cold or hot application method, each of which is relatively simple. Because adhesive 10 is a removable pressure sensitive adhesive, even when adhesive 10 is not applied exactly as desired initially, it can be removed in portions and repositioned very easily to attain the desired coverage of the masking surface. Thus, the masking process is easier, less messy and more accurate than using hot melt glues. In addition, adhesive 10 has a tack which is suitable to allow adhesive 10 to remain attached during the blasting of abrasive blast media even at angles which would pry most adhesives away from the masking surface. Further, the adhesive nature on all exterior surfaces allows for the formation of the barrier layer of blast media which repels additional blast media. Adhesive 10 thus provides an excellent masking material which itself is not abraded during the blasting process. Further, the stretching characteristics of adhesive 10 helps prevent it from being removed during the blasting process while also allowing it to be removed even from cracks and crevices which would be problematic for the removal of rigid materials such as solidified hot melt glue.

While the present invention has been described primarily as a method of masking with adhesive 10 to protect against abrasion during the abrasive blasting process, nonetheless the scope of the invention is contemplated more broadly as the use of adhesive 10 as a masking material for virtually any other purpose for which masking is typically required. Thus, adhesive 10 may be used to protect a masking surface during the removal of material forming a target surface or for coating the target surface with a coating material of some sort. Removal of the layer forming the target surface may involve physical interaction of an interactive material, of which blasting media is an example. In addition, an interactive material such as a chemical stripper may cause chemical interaction with the target surface material to remove said material. In addition, cleaning solvents may be utilized for cleaning the target surface without affecting the masking surface protected by adhesive 10.

In addition, the target surface may be coated with paint, which is a logical follow-up after depainting an aircraft or other target structure. Likewise, the target surface might be coated with a plastic, an elastomer, a foam, an insulating material or the like. Such coatings may even involve metal plating, such as electroplating, vacuum metallizing and so forth. As will appreciated by one skilled in the art, the possibilities are wide-ranging.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A method comprising the steps of:

adhering a removable pressure sensitive adhesive to a masking surface; and directly blasting the adhesive and a target surface adjacent the masking surface with abrasive blast media to remove material forming the target surface wherein the adhesive being blasted protects against removal of material forming the masking surface and wherein no additional masking layer is provided over the adhesive to protect the adhesive from being removed from the masking surface by the blast media.

2. The method of claim 1 wherein the step of adhering includes the step of applying the removable pressure sensitive adhesive in molten form to the masking surface.

3. The method of claim 2 wherein the step of adhering includes the step of adhering a removable pressure sensitive adhesive having a viscosity of 18,000 to 24,000 cPs at about 325° F. and 58,000 to 62,000 cPs at about 300° F.

4. The method of claim 2 wherein the step of applying includes the step of forming a projection of the adhesive in a cavity which extends inwardly from the masking surface; and further including the step of removing the adhesive from the masking surface and the cavity by stretching the adhesive in a manner that narrows the projection.

5. The method of claim 2 further comprising the step of melting the pressure sensitive adhesive prior to the step of applying.

6. The method of claim 1 further including the step of separating a flexible release liner from the adhesive.

7. The method of claim 1 wherein the step of adhering includes the step of adhering a removable pressure sensitive adhesive which has adhesive characteristics on all external surfaces thereof.

8. The method of claim 7 wherein the step of adhering includes the step of adhering a removable pressure sensitive adhesive which has adhesive characteristics throughout itself.

9. The method of claim 1 wherein the step of adhering includes the step of adhering a removable pressure sensitive adhesive having a composition comprising 40% to 50% by weight of block copolymers, 20% to 30% by weight of plasticizing oil and 24% to 34% by weight of a tackifying resin.

10. The method of claim 1 wherein the step of adhering includes the step of adhering a removable pressure sensitive adhesive having a 180° peel value to stainless steel of 1.1 to 1.3 pounds per linear inch.

11. The method of claim 1 wherein the step of adhering includes the step of adhering a removable pressure sensitive adhesive having a 90° peel value to stainless steel of 0.8 to 1.0 pounds per linear inch.

12. The method of claim 1 wherein the step of adhering includes the step of adhering a removable pressure sensitive adhesive having a loop tack value to stainless steel of 37 to 43 ounces per square inch.

13. The method of claim 1 further including the step of covering a portion of the masking surface with a masking device; and wherein the step of adhering includes the step of adhering the masking device to the masking surface with the adhesive.

14. The method of claim 13 wherein the step of covering comprises the step of covering a portion of the masking surface with a masking device by contacting the portion of the masking surface with the masking device; and the step of adhering comprises the step of adhering the masking device to the masking surface with the adhesive while the masking device remains in contact with the portion of the masking surface.

15. The method of claim 13 wherein the step of covering includes the step of covering the portion of the masking surface with a masking device in the form of a flexible sheet by positioning the sheet with a first side thereof facing the masking surface and a second opposed side thereof facing away from the masking surface; and further including the step of covering a portion of the second side of masking device along an edge thereof with the adhesive to secure the masking device to the masking surface for the duration of the step of blasting.

16. The method of claim 1 wherein the step of blasting includes the step of blasting the adhesive and target surface with the abrasive blast media at a pressure ranging from 25 to 100 psi.

17. The method of claim 1 wherein the step of blasting includes the step of adhering a portion of the blast media to the adhesive to form a barrier layer of blast media which repels additional blast media.

18. The method of claim 17 wherein the step of adhering the adhesive comprises the step of adhering to the masking surface a removable pressure sensitive adhesive having an exposed outer surface; and the step of adhering a portion of the blast media to the adhesive comprises the step of covering the exposed outer surface of the adhesive entirely with the portion of the blast media to form the barrier layer.

19. The method of claim 1 wherein the step of blasting includes the step of blasting the adhesive with blast media without abrading the adhesive.

20. The method of claim 1 wherein the step of adhering includes the step of adhering an inner surface of the adhesive to the masking surface so that an outer surface of the adhesive which is opposed to the inner surface is exposed and at least one edge of the adhesive which extends between and is connected to the inner and outer surfaces is exposed; and wherein the step of blasting includes the step of blasting the at least one edge of the adhesive without removing the adhesive from the masking surface.

21. The method of claim 1 further including the step of removing the adhesive from the masking surface by simply pulling the adhesive away from the masking surface.

22. The method of claim 21 wherein the step of removing the adhesive from the masking surface by simply pulling includes the step of pulling the adhesive from the masking surface so that the masking surface is essentially free of any residue caused by the adhesive.

23. The method of claim 1 further including the step of removing the adhesive from the masking surface without the use of tools.

24. The method of claim 1 wherein the step of adhering comprises the step of adhering to a masking surface a removable pressure sensitive adhesive able to elongate to a length which is twice its original length.

25. The method of claim 24 wherein the step of adhering comprises the step of adhering to a masking surface a removable pressure sensitive adhesive able to elongate to a length which is three times its original length.

26. The method of claim 25 wherein the step of adhering comprises the step of adhering to a masking surface a removable pressure sensitive adhesive able to elongate to a length which is five times its original length.

27. The method of claim 26 wherein the step of adhering comprises the step of adhering to a masking surface a removable pressure sensitive adhesive able to elongate to a length which is ten times its original length.

28. The method of claim 1 wherein the step of adhering comprises the step of adhering a removable pressure sensitive adhesive to a masking surface at a first location; further comprising the steps of:

removing the adhesive from the first location;

repositioning the removed adhesive to a position adjacent a second location of the masking surface; and adhering the repositioned adhesive to the second location of the masking surface; and wherein the step of blasting comprises the step of blasting the adhesive adhered at the second location with abrasive blast media wherein the adhesive protects against removal of material forming the masking surface at the second location.

29. The method of claim 1 further comprising the step of melting a hot melt removable pressure sensitive adhesive; and wherein the step of adhering comprises the step of applying the molten adhesive to the masking surface.

30. The method of claim 29 wherein the step of applying comprises the step of applying the molten adhesive to the masking surface at a temperature of at least 300° F.

31. The method of claim 30 wherein the step of applying comprises the step of applying the molten adhesive to the masking surface at a temperature ranging from 300 to 325° F.

32. The method of claim 1 further comprising the step of applying a coating material to the target surface subsequent to the step of blasting.

33. The method of claim 32 wherein the step of applying comprises the step of applying paint to the target surface.

34. The method of claim 32 wherein the step of applying comprises the step of applying a coating material from a group consisting of a plastic material, an elastomeric material, a foam material and an insulating material.

35. The method of claim 32 wherein the step of blasting comprises the step of removing a first coating material from a substrate formed of a material different than that of the coating material; and wherein the step of applying comprises the step of applying to the substrate in place of the first coating material a second coating material different than that of the substrate.

36. The method of claim 1 wherein the step of blasting comprises the step of blasting the adhesive and target surface with the blast media and an air/water mixture.

* * * * *